United States Patent [19]

Yuyama et al.

[11] Patent Number: 4,618,553

[45] Date of Patent: Oct. 21, 1986

[54] ELECTROPHOTOGRAPHIC RECORDING MATERIAL COMPRISES BACKING LAYER CONTAINING LONG-CHAIN ALKANOIC ACID METAL SALT

[75] Inventors: Yasuaki Yuyama; Junji Nakano; Shyunichi Kondo; Hideo Sato; Kenichi Sawada, all of Kanagawa, Japan

[73] Assignee: Fuji Photo Film Co., Ltd., Kanagawa, Japan

[21] Appl. No.: 737,967

[22] Filed: May 28, 1985

[30] Foreign Application Priority Data

May 28, 1984 [JP] Japan ..... 59-108010

[51] Int. Cl.[4] ..... G03G 5/10

[52] U.S. Cl. ..... 430/69; 430/56

[58] Field of Search ..... 430/56, 59

[56] References Cited

U.S. PATENT DOCUMENTS 3,501,294 3/1970 Joseph ..... 430/125

4,150,987 4/1979 Anderson ..... 430/58

*Primary Examiner*—John D. Welsh

*Attorney, Agent, or Firm*—Sughrue, Mion, Zinn, Macpeak and Seas

[57] ABSTRACT

An electrophotographic recording material is disclosed. The material comprises a support having provided thereon a photoconductive layer, in which a backing layer containing a long-chain alkanoic acid metal salt is provided on the reverse side of the support. The material has improved slipping property and excellent running durability.

11 Claims, No Drawings

ELECTROPHOTOGRAPHIC RECORDING MATERIAL COMPRISES BACKING LAYER CONTAINING LONG-CHAIN ALKANOIC ACID METAL SALT

FIELD OF THE INVENTION

This invention relates to an electrophotographic recording material and, more particularly, to an electrophotographic recording material having an improved slipping property and excellent running durability.

BACKGROUND OF THE INVENTION

Known processes for image formation by electrophotography include a process wherein a toner image is recorded on an electrophotographic photoreceptor and then transferred to ordinary paper, a process in which an image is directly formed on a recording material comprising a support, such as paper and films, having provided thereon an electrophotographic photoreceptor, and the like. Materials that have been employed for the electrophotographic photoreceptors include inorganic materials, e.g., selenium, cadmium sulfide, zinc oxide, and the like. With the recent development of organic electrophotographic photoreceptors, such as those comprising poly-N-vinylcarbazole and 2,4,7-trinitrofluoren-9-one as disclosed in U.S. Pat. No. 3,484,237; those prepared by sensitizing poly-N-vinylcarbazole with pyrylium salt dyes as disclosed in U.S. Pat. No. 3,617,268 corresponding to Japanese Patent Publication No. 25658/73; those consisting mainly of organic pigments as disclosed in U.S. Pat. No. 3,898,084 corresponding to Japanese Patent Application (OPI) No. 37543/72 (the term "OPI" as used herein means "unexamined published application"); those consisting mainly of eutectic complexes composed of dyes and resins as disclosed in U.S. Pat. Nos. 3,732,180 and 3,684,502 which correspond to Japanese Patent Application (OPI) No. 10785/72; and the like, it has become easy to produce photoreceptors by coating organic photoconductive materials as such or as a mixture with an appropriate binder on a support.

Furthermore, it has also become possible to produce light-transmitting electrophotographic recording materials by properly selecting the organic photoconductive materials and the supports (see *Optical Eng.*, Vol. 20, No. 3, 365 (1981)).

Compared with the commonly employed silver halide photographic recording materials, electrophotographic recording materials have their own advantages. For example, since the electrophotographic recording materials are not photosensitive until they are subjected to electrostatic charging, production and finishing thereof are easy; packaging therefor may be simple; and processings such as development can easily be carried out.

Electrophotography is further characterized in that exposure and development can repeatedly be effected on the same recording material. In other words, a silver halide recording material once having formed thereon an image by development processing cannot be used any more for recording another image. Whereas, according to electrophotography, images can be recorded on optional areas of the same recording material whenever desired.

On the other hand, in electrophotographic recording materials, particularly lengthwise long ones, a conductive material may fall off while being carried during charging, exposure and development and attach to unexposed areas or an exposed photosensitive layer surface which has been electrostatically charged to thereby leak a part of the electric charge, resulting in electrostatic contamination of an image, which appears as image noise.

Furthermore, when a lengthwise long electrophotographic photoreceptor prepared by using the recording material as described in *Research Disclosure*, Vol. 109, 61, "Electrophotographic Element, Materials and Processes" (May, 1973) is repeatedly used, friction between an image-recording surface and a back surface causes fall-off of the image or scratches on the image-recorded surface or back surface.

Furthermore, lengthwise long electrophotographic recording materials involve disadvantages such as deterioration of the driving property of cameras, projectors or reading apparatus and causing film chips.

In order to overcome the above-described disadvantages associated with electrophotographic recording materials, improvement of slipping property by reducing the friction coefficient of the recording materials has been considered. However, proposals in this direction have scarcely been made in the field of electrophotographic recording materials. To the contrary, a variety of techniques have been disclosed to this effect in the field of silver halide recording materials.

Examples of known techniques for improving the slipping property of silver halide recording materials include a method of adding a certain kind of gelatin hardener to a photographic constituting layer to heighten the strength against scratches, as described in British Pat. No. 1,270,578; a method of simultaneously adding dimethyl silicon and a specific surfactant to a photographic emulsion layer or a protective layer thereby to impart the slipping property to the layer, as described in U.S. Pat. No. 3,042,522; a method comprising coating a mixture of dimethyl silicon and diphenyl silicon on a back surface of a photographic film base thereby to impart the slipping property, as described in U.S. Pat. No. 3,080,317; a method comprising incorporating triphenyl terminal-blocked methylphenyl silicone in a protective layer to impart the slipping property to the photographic film, as described in British Pat. No. 1,143,118; and a method for preventing the uppermost layer from disadvantageous adhesion to different substances due to contact, which comprises dispersing spherical particles of the so-called matting agent, such as inorganic compounds (e.g., silver halide, silica, stronitium barium sulfate, etc.) and high polymers (e.g., polymethyl methacrylate latex, etc.), in a surface layer of a light-sensitive material thereby forming a matted dry film.

Application of such backing layers according to these known techniques proposed for silver halide recording materials to the electrophotographic films was thought to surely bring about considerable improvement of running durability of the films with less susceptibility to scrathes during running on either a photosensitive surface or a backing surface.

However, such techniques turned out to adversely affect the electrophotographic characteristics except in some special cases. More specifically, with an elapse of time under normal humidity or high humidity, a part of the composition of the backing layer is transferred to the photosensitive layer, resulting in suppression of surface charging, reduction of sensitivity, increase of a residual potential, unevenness of image formation, and the like.

SUMMARY OF THE INVENTION

Accordingly, an object of this invention is to improve the slipping property of electrophotographic recording materials without deteriorating the electrophotographic properties.

As a result of extensive investigations, it has now been found that the above-mentioned problems can be solved by an electrophotographic recording material comprising a support having provided thereon a photoconductive layer, in which the photoconductive layer has provided on the reverse side thereof a layer containing a long-chain alkanoic acid metal salt represented by the formula:

$$(RCOO)_nM$$

wherein M represents a mono-, di- or trivalent metal; R represents an alkyl group having from 12 to 21, preferably from 12 to 17, carbon atoms; and n represents 1, 2, or 3.

DETAILED DESCRIPTION OF THE INVENTION

Metals for forming the long-chain alkanoic acid metal salts which can be used in the present invention include calcium, magnesium, barium, lead, zinc, copper, aluminum and sodium, with calcium, barium, zinc and lead being preferred. Calcium, barium and zinc are most preferred.

Specific examples of the long-chain alkanoic acid metal salt include metal salts of lauric acid, e.g., sodium laurate, calcium laurate, barium laurate, magnesium laurate, lead laurate, zinc laurate, copper laurate, aluminum laurate, etc.; metal salts of stearic acid, e.g., sodium stearate, calcium stearate, magnesium stearate, barium stearate, lead stearate, zinc stearate, copper stearate, aluminum stearate, etc.; metal slats of behenic acid, e.g., sodium behenate, calcium behenate, magnesium behenate, barium behenate, lead behenate, zinc behenate, copper behenate, aluminum behenate, etc.; and the like. The preferred among them are those which do not have an influence on the photographic properties and are suitable for reading using a reading apparatus, with specific examples thereof including calcium laurate, barium laurate, magnesium laurate, lead laurate, zinc laurate, calcium stearate, magnesium stearate, barium stearate, lead stearate, zinc stearate and zinc behenate. Zinc stearate and zinc laurate are most preferred.

The long-chain alkanoic acid metal salt according to the present invention is coated on a support together with a binder to form a backing layer. The backing layer may further contain, if desired, an antistatic agent, a coating aid, a colorant, a film property-improving agent, and the like.

Binders which can be used in the backing layer according to the present invention may be any of conventional synthetic or natural high polymer binders that are soluble in water or organic solvents and capable of forming a coating film. The synthetic high polymers include a polyamide resin, polyacrylonitrile, vinyl resins, e.g., polyvinyl alcohol, polyvinyl chloride, polyvinylidene chloride, etc., a polycarbonate resin, a polyester resin, an unsaturated polyester resin, a polystyrene resin, a polyethylene resin, acrylic rsins, e.g., polyethyl acrylate, polyethyl methacrylate, etc., synthetic rubbers, and the like.

The natural high polymers include cellulose high polymers, e.g., acetylcellulose, nitrocellulose, etc., proteinous high polymers, e.g., casein, etc., and derivatives of natural rubber, gutta-percha, balata, etc.

The preferred among them are those which have no adverse influence on photographic properties and also exhibit moderate hardness and flexibility, with specific examples being cellulose high polymers, e.g., acetylcellulose, nitrocellulose, etc., a polycarbonate resin, a saturated polyester resin, and acrylic resins, e.g., polyethyl methacrylate, etc. Acetylcellulose is most preferred.

Antistatic agents that can preferably be used in the present invention include those agents which exhibit compatibility with a binder and which do not make the surface of the layer cloudy or do not become a bar to improvement of the slipping property when dispersed. Examples of such antistatic agents include anionic surface active agents, such as alkyl sulfates, alkylaryl sulfates, alkanoic acid phosphates, alkyl phosphates, etc.; cationic surface active agents, such as amine neutralized salts, quaternary ammonium salts, complex ion salts, etc.; amphoteric surface active agents, such as betain, sulfobetain heavy metal salts, etc.; nonionic surface active agent, such as sorbitan fatty acid ester monoglycerides, polyoxyethylene alkyl ethers, polyoxyethylene alkylamines, trialkyl phosphates, etc.; and semi-polar surface ative agents, such as amine oxides, bisglyceryl borate monoalkylates, etc.

These antistatic agents may also serve as coating aids. Additional examples of usable coating aids include nonionic surface active agents, such as alkylene oxide derivatives, fatty acid esters of polyhydric alcohols, etc.; anionic surface active agents, such as alkylbenzenesulfonates, alkyl phosphates, etc.; amphoteric surface active agents, such as amino acids, amino oxides, etc.; and cationic surface active agents, such as aliphatic or heterocyclic phosphonium salts, etc.

Colorants may be used if it is desired to distinguish products. Examples of usable colorants include dyes generally called oil-soluble dyes, such as azo dyes or metal complex salt azo dyes, e.g., Orient Oil Yellow GG (produced by Orient Chemical Ind., Ltd.), Aizen Spilon Violet RH (produced by Hodogaya Chemical Co., Ltd.), Aizon Spilon Red REH (produce by Hodogaya Chemical Co., Ltd.), etc.; anthraquinone dyes and phthalocyanine dyes, e.g., Sumiplast Blue OA (produced by Sumitomo Chemical Co., Ltd.), Oil Green BB (Hakudo Co., Ltd.), Orient Oil Red #330 (produced by Orient Chemical Ind., Ltd.), etc.; disazo dyes; and so on.

The film property-improving agent which can be used in the present invention is an additive for improving the flexibility of the coating layer or adhesiveness of the layer to a film support, with specific example thereof including acetate type binders, such as linear polyesters, e.g., Staffix (produced by Fuji Photo Film Co., Ltd.), Vylon 200 (produced by Toyo Spinning Co., Ltd.), and plasticizers, e.g., Desmocol #176 (produced by Bayer A.G.), a polyurethane resin, triphenyl phosphate (produced by Daihachi Chemical Ind. Corp.), etc. Staffix is preferred.

The long-chain alkanoic acid metal salt of the present invention is dissolved or dispersed in water or an organic solvent together with a binder and, if desired, an antistatic agent, a coating aid, a colorant and a film property-improving agent, and the resulting coating composition is coated on a support to form a backing layer. The organic solvents to be used for the coating composition are not particularly restricted and are appropriately selected from ketones, e.g., acetone, methyl ethyl ketone, cyclohexanone, etc.; aromatic hydrocarbons, e.g., benzene, toluene, xylene, etc.; chlorinated hydrocarbons, e.g., chloroform, dichloroethane, methylene chloride, etc.; ethers, e.g., tetrahydrofuran, dioxane, etc.; alcohols, e.g., ethyl acetate, butyl acetate, etc.; aprotic polar solvents, e.g., N,N-dimethylformamide, dimethyl sulfoxide, etc.; and the like.

The long-chain alkanoic acid metal salt according to the present invention is usually used in an amount ranging from 5 to 50 parts by weight, and preferably from 15 to 30 parts by weight, per 100 parts by weight of a binder. It is preferred that the long-chain alkyl metal salt is added in such an amount as to result in a backing layer having a kinetic friction coefficient of not greater than 0.35, and more preferably not greater than 0.3.

A kinetic friction coefficient of a backing layer can be measured in accordance with the method specified by ASTM D1894 by means of, for example, a kinetic friction tester, Haydn Model 14 (manufactured by Shinto Kagaku K.K.).

The backing layer of the present invention contains, if desired, from 5 to 30 parts by weight of an antistatic agent, from 2 to 20 parts by weight of a coating aid, from 0.05 to 5 parts by weight of a colorant and from 2 to 40 parts by weight of a film property-improving agent each per 100 parts by weight of a binder.

The backing layer can be formed by applying the above-described coating composition onto a support by a known coating method, such as bar coating, blade coating, air knife coating, gravure coating, roll coating, spray coating, dip coating,. etc., followed by drying.

The coating composition is coated to a coverage of from 10 to 500 g/m$^2$, and preferably from 50 to 200 g/m$^2$, on a dry basis. The amount of the binder in the backing layer is about 0.1 to 20 g/m$^2$, preferably about 0.5 to 10 g/cm$^2$, on a dry basis.

A support which can be used in the present invention comprises a semi-synthetic or synthetic high polymer substrate, e.g., cellulose nitrate, cellulose acetate, polystyrene, polyvinyl chloride, polyethylene terephthalate, polycarbonate, etc., having provided thereon a conductive layer by coating or vacuum evaporating a conductive compound, such as a conductive polymer indium oxide, tin oxide, etc. A preferred support comprises a polyethylene terephthalate film having vacuum evaporated thereon indium oxide.

The electrophotographic recording material in accordance with the present invention comprises a photoconductive layer provided on the aforesaid conductive layer and further comprises, if desired, a subbing layer, an intermediate layer and a surface protective layer.

The layer structure of the photoconductive layer includes a single layer structure composed of an organic photoconductive material dispersed in a binder or a medium for transporting a charge carrier and a laminate structure comprising a layer containing an organic photoconductive material and a charge carrier-transporting medium laminated thereon.

The photoconductive layer or intermediate layer can be formed by a conventionally well known method.

The present invention will now be illustrated in greater detail with reference to examples, but the present invention should not be limited thereto. In these examples, all the parts are given by weight.

EXAMPLE 1

The following components were thoroughly kneaded in a ball mill to prepare a dispersion:

| | |
|---|---|
| Triacetyl Cellulose | 4 parts |
| Dichloromethane | 75 parts |
| Methanol | 8 parts |
| Zinc Stearate | 1 part |

To 1 part of the dispersion thus prepared was added 13 parts of methyl ethyl ketone, and the mixture was stirred in a paddle-type stirrer to prepare a coating composition for a backing layer.

The coating composition was coated on one side of a 100 μm thick polyethylene terephthalate film to a dry film thickness of 0.5 μm using a continuous coating machine, on another side of the polyethylene terephthalate film, indium oxide having been vacuum evaporated to a thickness of about 0.05 μm. The coated film was dried at 125° C. for 4 minutes to form a backing layer.

Onto the indium oxide-vacuum evaporated side of the support was formed a photoconductive layer mainly comprising polyvinylcarbazole to a dry thickness of about 10 μm to thereby prepare Electrophotographic Film A.

For comparison, Films B and C were prepared in the same manner as described above except that zinc stearate was excluded from the coating composition and that the zinc stearate was replaced by $C_{12}H_{25}OSO_3.Na$, respectively.

Each of the resulting film samples (A to C) was evaluated for various properties by the following tests. The results obtained are shown in Table 1.

(1) Measurement of Kinetic Friction Coefficient

The film was cut into a size of 6.3 mm×6.3 mm, and one piece was mounted on the sliding tester (made by Shinto Kagaku K. K.) and contacted with another piece of the film (17 cm×10 cm) set on a flat plane under a load of 100 g in such a manner that the backing layers of both sample pieces were in contact with each other. The resistance when the friction element was slided at a speed of 50 mm/min. was detected by means of a strain gauge and automatically recorded on a chart.

(2) Running Durability

The film was cut into a width of 16 mm and a length of 5 m. The film sample was wound around a winding roll and a re-winding reels via two rotating rolls placed at a distance of 70 mm in such a manner that the backing layer of the sample contacts the rolls. Thereafter, the tension between the two reels was adjusted to about 300 g.

The sample was run between two reels 1,000 times by means of an automatic driving motor, and occurrence of scratches on the backing layer was observed. Running durability was evaluated according to the following scales:

A: The film surface received substantially no scratches.

B: The film received slight scratches.

C: The film received serious scratches and did not stand practical use.

(3) Influence on Recording Layer by Transfer

The film was cut into a size of 21 cm×30 cm, and two sample pieces were overlapped and interposed between a pair of flat vinyl chloride plates under a load of 2 kg in such a manner that the backing layer of one sample and the recording layer of another sample faced to each other. The two-sample set was allowed to stand in a thermostat at 45° C. and 90% RH for 7 days. After being taken out from the thermostat, they were subjected to the following tests.

(i) Surface Properties

The two samples gently peeled apart with hands, and the surface gloss, blocking, exudation of different substances, and the like were all-inclusively examined.

(ii) Unevenness of Development

The sample film with its recording layer having been contacted with the backing layer of another film was cut into a size of 7 cm×14 cm and was allowed to stand in an atmosphere of 23° C. and 55% RH for 4 hours. It was then subjected to positive development according to usual electrophotographic development processing using a developing solution KV-10TK for Panacopy Slide Processor (made by Matsushita Electric Ind. Co., Ltd.). Unevenness of the development was visually evaluated based on the following scales:

A: No abnormality was noted compared with the film before testing.

B: Slight abnormality was noted.

C: Conspicuous abnormality was noted so that the film did not stand practical use.

TABLE 1

| Sample Number | Kinetic Friction Coefficient | Running Durability | Influence on Recording Layer by Transfer: Surface Property | Influence on Recording Layer by Transfer: Unevenness of Development |
|---|---|---|---|---|
| A (Invention) | 0.2 | A | A | A |
| B (Comparison) | 0.39 | C | A | A |
| C (Comparison) | 0.23 | A | C | C |

As is apparent from Table 1, it can be seen that Film A according to the present invention is entirely free from adverse influences caused by transfer upon photosensitive materials while retaining excellent performance properties, such as slipping property and scratch resistance.

EXAMPLE 2

Electrophotographic Film D was prepared in the same manner as in Example 1 except that a coating composition for a backing layer was prepared as follows.

The components shown below are thoroughly mixed in a ball mill to prepare a dispersion:

| | |
|---|---|
| Diacetyl Cellulose | 4 parts |
| Acetone | 70 parts |
| Methanol | 7 parts |
| Zinc Stearate | 1 part |

To 81.3 parts of the resulting dispersion was added 700 parts of acetone to prepare a coating composition for a backing layer.

For comparison, Films E and F were prepared in the same manner as above except for using 0.3 part of a silica fine powder and 3 parts of $C_{12}H_{41}CONH_2$, respectively, in place of the zinc stearate.

Each of the resulting films (D to F) was tested in the same manner as in Example 1, and the results obtained are shown in Table 2.

TABLE 2

| Sample Number | Kinetic Friction Coefficient | Running Durability | Influence on Recording Layer by Transfer: Surface Property | Influence on Recording Layer by Transfer: Unevenness of Development |
|---|---|---|---|---|
| D (Invention) | 0.20 | A | A | A |
| E (Comparison) | 0.36 | C | A | A |
| F (Comparison) | 0.30 | B | C | C |

It can be seen from Table 2 that Film D according to the present invention withstands the adverse influence of transfer while retaining excellent performance properties, i.e., slipping property and scratch resistance.

EXAMPLE 3

Electrophotographic films were prepared in the same manner as described in Example 1 except that the zinc stearate as used in Example 1 was replaced by the long-chain alkanoic acid metal salt shown in Table 3. Film properties were evaluated in the same manner as in Example 1, and the results are shown in Table 3.

TABLE 3

| Long-Chain Alkanoic Acid Metal Salt | Kinetic Friction Coefficient | Running Durability | Influence on Recording Layer by Transfer: Surface Property | Influence on Recording Layer by Transfer: Unevenness of Development |
|---|---|---|---|---|
| Barium Stearate | 0.16 | A | A | A |
| Copper Stearate | 0.24 | A | A | A |
| Lead Stearate | 0.17 | A | A | A |
| Zinc Behenate | 0.22 | A | A | A |
| Zinc Laurate | 0.22 | A | A | A |

It can apparently be seen from Table 3 that the electrophotographic films wherein the long-chain alkanoic acid metal salts were used in accordance with the present invention are entirely free from adverse influence due to transfer upon images, while retaining excellent properties, i.e., slipping property and scratch resistance.

EXAMPLE 4

An electrophotographic film was prepared in the same manner as in Example 1 except that the coating composition for a backing layer further contained 1 part

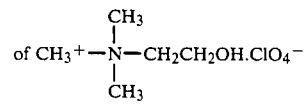

as an antistatic agent. The resulting film was tested in the same manner as in Example 1. It was found that the film had a kinetic friction coefficient of 0.2, that is equal to that of Sample A of Example 1, had good running durability and was free from the influence due to transfer upon the recording layer. Further, addition of the antistatic agent was found to bring about reduction of electric resistivity of the backing layer from $10^{15}$ ohm·cm to $10^{10}$ ohm·cm.

While the invention has been described in detail and with reference to specific embodiments thereof, it will be apparent to one skilled in the art that various changes and modifications can be made therein without departing from the spirit and scope thereof.

What is claimed is:

1. An electrophotographic recording material comprising a support having provided thereon a photoconductive layer and a backing layer provided on the opposite side of the support, wherein said backing layer comprises a binder and a long-chain alkanoic acid metal salt represented by the formula:

$$(RCOO)_nM$$

wherein M represents a mono-, di- or trivalent metal; R represents an alkyl group having from 12 to 21 carbon atoms and n represents 1, 2 or 3.

2. An electrophotographic recording material as claimed in claim 1, wherein the long-chain alkanoic acid metal salt is calcium laurate, barium laurate, magnesium laurate, lead laurate, zinc laurate, calcium stearate, magnesium stearate, barium stearate, lead stearate, zinc stearate or zinc behenate.

3. An electrophotographic recording material as claimed in claim 1, wherein the long-chain alkanoic acid metal salt is present in an amount of from 5 to 50 parts by weight per 100 parts by weight of a binder.

4. An electrophotographic material as claimed in claim 3, wherein the long-chain alkanoic acid metal salt is present in an amount of from 15 to 30 parts by weight per 100 parts by weight of a binder.

5. An electrophotographic recording material as claimed in claim 1, wherein the long-chain alkanoic acid metal salt is present in such an amount that the backing layer may have a kinetic friction coefficient of not greater than 0.35.

6. An electrophotographic recording material as claimed in claim 5, wherein the long-chain alkanoic acid metal salt is present in such an amount that the backing layer may have a kinetic friction coefficient of not greater than 0.3.

7. An electrophotographic recording material as claimed in claim 1, wherein said binder is selected from the group consisting of synthetic polymer binders and natural high polymer binders.

8. An electrophotographic recording material as claimed in claim 7, wherein said synthetic high polymer binders are selected from the group consisting of a polyamide resin, a polyester resin, an unsaturated polyester resin, a polystyrene resin, a polyethylene resin, an acrylic resin and synthetic rubber.

9. An electrophotographic recording material as claimed in claim 7, wherein said natural high polymer binders are selected from the group consisting of cellulose high polymers, proteinous high polymers, derivatives of natural rubber, gutta-percha and balata.

10. An electrophotographic recording material as claimed in claim 1, wherein the amount of said binder is about 0.1 to 20 g/m$^2$ on a dry basis.

11. An electrophotographic recording material as claimed in claim 10, wherein the amount of said binder is about 0.5 to 10 g/m$^2$ on a dry basis.

* * * * *